US008657972B2

(12) United States Patent
Putatunda

(10) Patent No.: US 8,657,972 B2
(45) Date of Patent: Feb. 25, 2014

(54) DEVELOPMENT OF A HIGH STRENGTH HIGH TOUGHNESS STEEL

(75) Inventor: Susil K. Putatunda, Bloomfield, MI (US)

(73) Assignee: Wayne State University, Detroit, MI (US)

( * ) Notice: Subject to any disclaimer, the term of this patent is extended or adjusted under 35 U.S.C. 154(b) by 243 days.

(21) Appl. No.: 12/920,421

(22) PCT Filed: Dec. 24, 2008

(86) PCT No.: PCT/US2008/088319

§ 371 (c)(1), (2), (4) Date: Aug. 31, 2010

(87) PCT Pub. No.: WO2009/086461

PCT Pub. Date: Jul. 9, 2009

(65) Prior Publication Data

US 2011/0114233 A1 May 19, 2011

Related U.S. Application Data

(60) Provisional application No. 61/016,795, filed on Dec. 26, 2007.

(51) Int. Cl.

| | |
|---|---|
| ***C22C 38/42*** | (2006.01) |
| ***C22C 38/44*** | (2006.01) |
| ***C21D 6/00*** | (2006.01) |

(52) U.S. Cl.

USPC ..... 148/335; 148/321; 148/332; 148/579; 148/663; 420/108; 420/117

(58) Field of Classification Search

USPC ..... 148/579, 660, 662, 663, 320, 332–335, 148/321; 420/117, 77, 78, 79, 104–108

See application file for complete search history.

(56) References Cited

U.S. PATENT DOCUMENTS

| | | | | |
|---|---|---|---|---|
| 5,043,028 | A | 8/1991 | Kovacs et al. | |
| 5,139,579 | A | 8/1992 | Kovacs et al. | |
| 2005/0150580 | A1 * | 7/2005 | Akamizu et al. | 148/654 |

FOREIGN PATENT DOCUMENTS

| | | | |
|---|---|---|---|
| JP | 60-005820 | A | 1/1985 |
| JP | 04-52218 | * | 2/1992 |
| JP | 04-052218 | A | 2/1992 |
| JP | 05-320749 | A | 12/1993 |
| JP | 07-173571 | A | 7/1995 |

OTHER PUBLICATIONS

Machine-English translation of Japanese patent 05-320749, Tagashira Satoshi et al., Dec. 3, 1993.*

Machine-English translation of Japanese patent 2003-306741, Yanagisawa Taira et al., Oct. 31, 2003.*

ASM Handbook, vol. 20, Materials Selection and Design, "Iron and Steels", pp. 369-371, 1977.*

(Continued)

*Primary Examiner* — Deborah Yee

(74) *Attorney, Agent, or Firm* — Brooks Kushman P.C.

(57) ABSTRACT

A bainitic steel with simultaneous high yield strength and high fracture toughness includes at least 5 volume percent austenite as well as iron, carbon, and silicon. The silicon is present in an amount of at least 1.5 weight percent of total weight of the bainitic steel. A method of forming the steel by austempering is also provided.

19 Claims, 16 Drawing Sheets

(56) References Cited

OTHER PUBLICATIONS

English-hand translation of Japanese patent 4-52218, Shinya Mizuno, Feb. 20, 1992.*

Mumtaz, K. et al, "Use of saturation magnetism to detect martensite formation in austenitic stainless steel after compressive deformation at high temperatures," Journal of materials Science Letters 21, pp. 1199-1201 (2002).

Putatunda, S.K, "Fracture Toughness of a High Carbon and High Silicon Steel," Materials Science and Engineering A297 (2001), pp. 31-43.

Li, Y. et al., "Microstructure and Mechanical Properties of Austempered High Silicon Cast Steel," Materials Science and Engeineering A308 (2001), pp. 277-282.

* cited by examiner

DEVELOPMENT OF A HIGH STRENGTH HIGH TOUGHNESS STEEL

CROSS REFERENCE TO RELATED APPLICATIONS

This application is the U.S. national phase of PCT Appln. No. PCT/2008/088319 filed 24 Dec. 2008 which claims the benefit of U.S. Provisional Application No. 61/016,795 filed 26 Dec. 2007, which is incorporated by reference herein in its entirety.

BACKGROUND OF INVENTION

1. Field of the Invention

The present invention relates to high strength, high toughness Bainitic Steels.

2. Background Art

Austempered Ductile Cast Iron (ADI) has emerged as a major engineering material in recent years because of its excellent properties, such as high strength with good ductility, good wear resistance, good fatigue properties, and good fracture toughness. ADI is widely used in manufacturing components such as gears, crankshafts, and locomotive wheels, connecting rods, brake shoes, and the like. ADI has other advantages, such as low production cost arising from its good castability, excellent machinability resulting in consequently longer tool life, and shorter heat treatment processing cycles.

ADI is an alloyed and heat-treated nodular cast iron. It has a unique acicular matrix structure that consists of high carbon austenite ($\gamma_{HC}$) and ferrite ($\alpha$) with dispersed graphite nodules. This unique microstructure, the product of the austempering process, provides the excellent mechanical and physical properties of ADI.

During austempering, ADI goes through a two-stage phase transformation process. In the first stage, the austenite ($\gamma$) decomposes into ferrite ($\alpha$) and high carbon austenite ($\gamma_{HC}$):

$$\gamma \rightarrow \alpha + \gamma_{HC} \quad (1)$$

If the casting is held at the austempering temperature for too long, a second reaction takes place, during which the high carbon austenite $\gamma_{HC}$ can further decompose into ferrite and carbide:

$$\gamma_{HC} \rightarrow \alpha + \epsilon \quad (2)$$

Steels with bainitic structure have several advantages including high strength, high toughness, and high ductility. In conventional steels, generally, the fracture toughness decreases as yield strength increases. On the other hand, the fracture toughness will be high when the yield strength is low. Thus, the combination of high strength and high fracture toughness cannot easily be obtained in most conventional steels.

When steel is austempered at temperatures below the noise of the TTT (Time Temperature and Transformation) curve, a structure is produced in which ferrite and iron carbide are not lamellar. This transformation product is called bainite. Bainite in steel has a needle-like (acicular) microstructure. Whereas pearlite is nucleated by iron carbide and is accompanied by the subsequent formation of ferrite, bainite is nucleated by ferrite, followed by the precipitation of iron carbide. This process leads to the dispersion of iron carbide in a ferrite matrix. With a lower transformation temperature, the distribution of carbide is finer and the ferrite needles are thinner. This product is called lower bainite. The transformation product at relatively higher temperatures consists of lath or plate-shaped ferrite units arranged in packets and interlath carbide precipitates. This product is called upper bainite. In steel, lower bainite produces higher yield strength but lower toughness. While the austempering reaction in ADI is a two-step reaction process, it is a one-step reaction process in the case of steel. During austempering in steel, austenite directly decomposes into acicular ferrite and carbide (bainite). Austempering of steel offers the advantages of increased ductility, reduced distortion, and a short overall time cycle to harden thoroughly. Generally, upper bainitic temperatures are above 316° C. (600° F.) in the case of steels and cast iron. Temperatures between 232° C. (450° F.) to 316° C. (600° F.) are the lower bainitic temperature range.

Accordingly, there is a need for new steels simultaneously exhibiting high yield strength and high fracture toughness.

SUMMARY OF THE INVENTION

The present invention solves one or more problems of the prior art by providing in at least one embodiment, a bainitic steel with simultaneous high yield strength, ductility, and high fracture toughness. The bainitic steel includes at least 5 volume percent austenite and at least 80 volume percent ferrite. The bainitic steel's composition includes iron, carbon, and an additional component selected from the group consisting of silicon, aluminum, and any combination thereof. The additional component is present in an amount of at least 1.5 weight percent of total weight of the bainitic steel. In this embodiment, the bainitic steel includes austenitic and bainitic ferrite in a very fine-grained structure with the austenite sufficiently enriched with carbon so that its Ms (Martenite Start) temperature is sufficiently depressed to impart high strength and other mechanical properties on the steel.

In another embodiment, a method of forming the Bainitic steel set forth above is provided. The method of this embodiment utilizes a variation of Austempered Ductile Cast Iron (ADI) technology. The method of this embodiment comprises providing a steel alloy composition comprising iron, carbon, and an additional component selected from the group consisting of silicon, aluminum and any combination thereof. The additional component is present in an amount of at least 1.5 weight percent of the total weight of the steel alloy composition. The steel alloy composition is heated to a temperature of at least 500° F. The temperature of the steel alloy composition is maintained at a temperature of at least 500° F. for a period of time sufficient to induce transformation of at least a portion of the steel alloy to austenite.

DETAILED DESCRIPTION OF THE PREFERRED EMBODIMENT(S)

Figure 1:
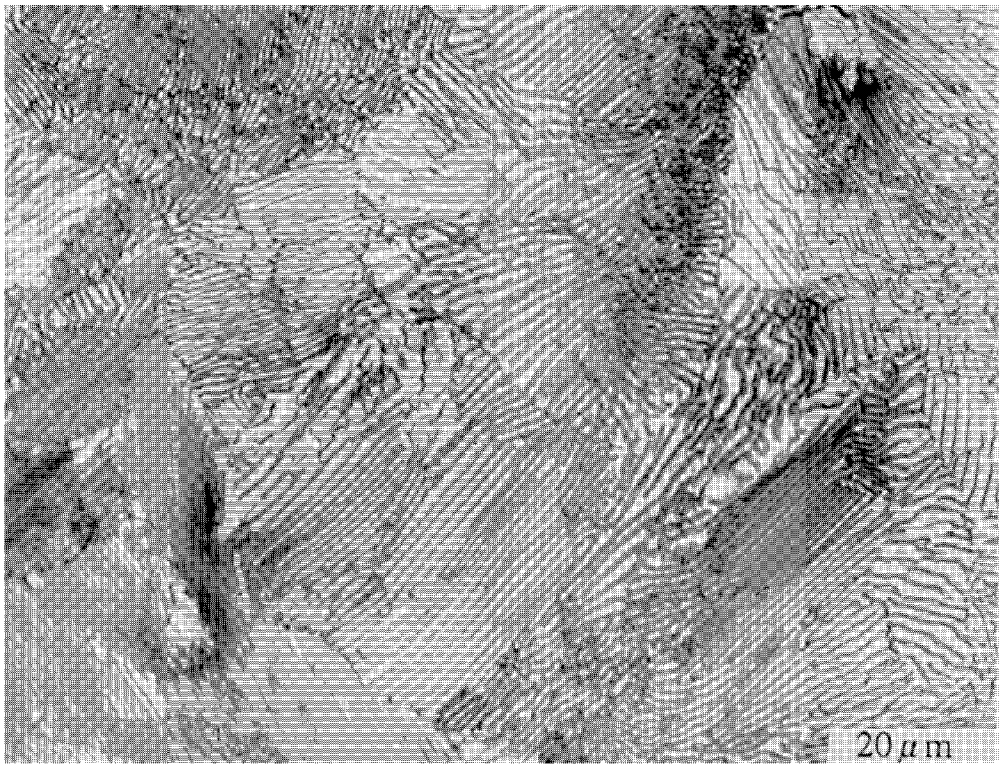
FIG. 1 provides the microstructure of HCHS steel in as-Cast condition.

Reference will now be made in detail to presently preferred compositions, embodiments and methods of the present invention, which constitute the best modes of practicing the invention presently known to the inventors. The Figures are not necessarily to scale. However, it is to be understood that the disclosed embodiments are merely exemplary of the invention that may be embodied in various and alternative forms. Therefore, specific details disclosed herein are not to be interpreted as limiting, but merely as a representative basis for any aspect of the invention and/or as a representative basis for teaching one skilled in the art to variously employ the present invention.

Except in the examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. The description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; the first definition of an acronym or other abbreviation applies to all subsequent uses herein of the same abbreviation; and, unless expressly stated to the contrary, measurement of a property is determined by the same technique as previously or later referenced for the same property.

It is also to be understood that this invention is not limited to the specific embodiments and methods described below, as specific components and/or conditions may, of course, vary. Furthermore, the terminology used herein is used only for the purpose of describing particular embodiments of the present invention and is not intended to be limiting in any way.

It must also be noted that, as used in the specification and the appended claims, the singular form "a," "an," and "the" comprise plural referents unless the context clearly indicates otherwise. For example, reference to a component in the singular is intended to comprise a plurality of components.

In an embodiment of the present invention, a bainitic steel with simultaneous high yield strength and high fracture toughness is provided. The bainitic steel of this embodiment comprises at least 5 volume percent austenite and at least 80 volume percent bainitic ferrite. In a refinement, the bainitic steel of this embodiment comprises at least 5 volume percent austenite and at least 80 volume percent bainitic ferrite. Moreover, the bainitic steel includes iron, carbon, and silicon. In a variation, a portion of or all of the silicon is replaced by aluminum. Characteristically, the silicon is present in an amount of at least 1.5 weight percent of total weight of the bainitic steel. In a refinement, the silicon is present in an amount from about 1.8 weight percent to about 5 weight percent. In still another refinement, the silicon is present in an amount from about 1.8 weight percent to about 2.5 weight percent. In still another variation, the bainitic steel includes silicon in an amount of at least 2 weight percent. Iron is typically present in an amount from about 94 to 98 weight percent. In a refinement, the iron is present in an amount from about 95 to about 98 weight percent. In still another refinement, the iron is present in an amount from about 97 to about 98 weight percent.

In another variation of the present embodiment, the bainitic steel comprises aluminum in an amount from about 1.8 weight percent to about 5 weight percent. In a further refinement of this variation, the bainitic steel comprises aluminum in an amount from about 1.8 weight percent to about 2.5 weight percent. In still another variation, the bainitic steel includes aluminum in an amount of at least 2 weight percent.

As set forth above, the bainitic steel of the present embodiment includes carbon. In one refinement, the carbon is present in an amount from about 0.2 weight percent to about 2.0 weight percent of the total weight of the bainitic steel. In another refinement, the carbon is present in an amount from about 0.3 weight percent to about 0.7 weight percent. In another refinement, the carbon is present in an amount from about 0.3 weight percent to about 0.6 weight percent.

In a variation of the present embodiment, the bainitic steel further comprises one or more of the following components: manganese, nickel, chromium, molybdenum, copper, sulfur, and/or phosphorus. In a refinement, the steel further comprises one or more of these components in the following ranges: manganese in an amount from about 0.1 to about 0.8 weight percent, nickel in an amount from about 0.5 to 2 weight percent, chromium in an amount from about 0.5 to about 1.5 weight percent, molybdenum in an amount from about 0.1 to about 0.6 weight percent, copper in an amount from about 0.1 to about 0.8 percent, sulfur in an amount from about 0.001 to about 0.01 weight percent, and/or phosphorus in an amount from about 0.001 to about 0.05 weight percent.

In another variation of the present embodiment, the bainitic steel includes at least 5 volume percent austenite and at least 80 volume percent bainitic ferrite. In another variation of the present embodiment, the bainitic steel includes at least 5 volume percent austenite and at least 90 volume percent bainitic ferrite. In a refinement, the bainitic steel includes from about 5 volume percent to about 20 volume percent austenite. In another variation, the bainitic steel includes bainitic ferrite in an amount from about 80 to 95 volume percent. In yet another variation, the bainitic steel includes bainitic ferrite in an amount from about 85 to 95 volume percent. In still another variation, the bainitic steel includes bainitic ferrite in an amount from about 90 to 95 volume percent.

In other variations, the bainitic steel includes plates of bainitic ferrite separated by carbon-enriched regions of austenite. The potential advantages of this mixed microstructure are as follows. Since cementite is responsible for initiating fracture in high-strength steels, its absence is expected to make the microstructure more resistant to cleavage failure and void formation. The bainitic ferrite is almost free of carbon, which substantially strengthens the ferrite. The microstructure derives its strength from the fine grain size of the ferrite plates, which are less than 1 μm in thickness. It is the thickness of these plates, which determines the mean free slip distance so that the effective grain size is less than a micrometer. Other commercially viable processes do not easily achieve such a grain size. Moreover, grain refinement is the only method available for simultaneously improving the strength and toughness of steels. The ductile films of austenite, which are intimately dispersed between the plates of ferrite, have a crack blunting effect. They further add to toughness by increasing the work of fracture as the austenite is induced to transform to martensite under the influence of the stress field of a propagating crack. This phenomenon is referred to as the transformation-induced plasticity effect (TRIP). The diffusion of hydrogen in austenite is slower than in ferrite. The presence of austenite can, therefore, improve the stress corrosion resistance. The present embodiment allows steels with the bainitic ferrite and austenite microstructure to be obtained without the use of expensive alloying elements. Instead, in a variation of the present embodiment, these advantages are obtained by having silicon or aluminum in a sufficient concentration to suppress cementite formation.

It should be appreciated that in spite of these appealing features, the observed microstructure does not in and of itself always give the expected good combination of strength and toughness. This is because the relatively large blocky regions of austenite between the sheaves of bainite readily transform into high-carbon martensite under the influence of stress. Such untempered, hard and coarse martensite regions severely embrittle the steel. However, when steels contain sufficient silicon or aluminum (exceeding 2.0%) and are austempered in the upper bainitic temperature range, they develop unique microstructure similar to ADI. The carbon that is partitioned in to residual austenite does not precipitate but remains stable to ambient temperature.

In another embodiment of the present invention, a method of forming the bainitic steel set forth above using an austempering process is provided. The method of this embodiment comprises:

a) providing a steel alloy composition comprising iron, carbon, and an additional component selected from the group consisting of silicon, aluminum, and combination thereof, the additional being present in an amount of at least 1.5 weight percent of the total weight of the steel alloy composition;

b) heating the steel alloy composition to a temperature of at least 500° F.; and c) maintaining the temperature of the steel alloy composition at a temperature of at least 500° F. for a period of time sufficient to induce transformation of at least a portion of the steel alloy to austenite. In a refinement, the steel alloy composition in step c) is maintained at a temperature of at least 500° F. under substantially isothermal conditions for a predetermined period of time. In another refinement, the steel alloy composition in step c) is maintained at a temperature between about 500 to about 800° F. In still another refinement, the steel alloy composition in step c) is maintained at a temperature between about 600 to about 750° F. In a variation of this embodiment, some or all of the silicon is replaced by aluminum.

In a variation of the present embodiment, the steel alloy is maintained at a temperature of at least 500° F. for a sufficient time to transform at least 5 volume percent of the steel alloy composition to austenite. In a refinement, the steel alloy is maintained at a temperature of at least 500° F. for a sufficient time to transform from about 5 volume percent to about 20 volume percent of the steel alloy composition to austenite.

In another variation of the present embodiment, the steel alloy composition comprises silicon in an amount from about 1.8 weight percent to about 5 weight percent. In a further refinement of this variation, the steel alloy composition comprises silicon in an amount from about 1.8 weight percent to about 2.5 weight percent. In still another variation, the steel alloy composition includes silicon in an amount of at least 2 weight percent.

In another variation of the present embodiment, the steel alloy composition comprises aluminum in an amount from about 1.8 weight percent to about 5 weight percent. In a further refinement of this variation, the steel alloy composition comprises aluminum in an amount from about 1.8 weight percent to about 2.5 weight percent. In still another variation, the steel alloy composition includes aluminum in an amount of at least 2 weight percent.

In another variation of the present embodiment, the steel alloy composition comprises carbon in an amount from about 0.2 weight percent to about 2.0 weight percent. In a further refinement, the steel alloy composition comprises carbon in an amount from about 0.3 weight percent to about 0.7 weight percent. In a further refinement, the steel alloy composition comprises carbon in an amount from about 0.3 weight percent to about 0.6 weight percent.

In other variations of the present embodiment, the steel alloy composition includes one or more of the following components: manganese, nickel, chromium, molybdenum, copper, sulfur, and/or phosphorus. In a refinement, the steel alloy composition further comprises one or more of these components in the following ranges: manganese in an amount from about 0.1 to about 0.8 weight percent, nickel in an amount from about 0.5 to 2 weight percent, chromium in an amount from about 0.5 to about 1.5 weight percent, molybdenum in an amount from about 0.1 to about 0.6 weight percent, copper in an amount from about 0.1 to about 0.8 percent, sulfur in an amount from about 0.001 to about 0.01 weight percent, and/or phosphorus in an amount from about 0.001 to about 0.05 weight percent.

In still another variation of the present embodiment, the steel alloy composition is austenized prior to step b) by heating at an elevated temperature. In a refinement, this elevated temperature is greater than about 700° C. In a refinement, this elevated temperature is greater than about 900° C.

The following non-limiting examples provide the composition and methods of the invention. Those skilled in the art will recognize variations of the present invention and scope of the claims.

Design of the Steel:

In a variation of the present embodiment, the alloy steel has an $M_s$ (martensite start) temperature below 600° F. This temperature is characteristically at the boundary line between upper and lower bainite. In a refinement, the steel with the following composition has been selected for this investigation. (C=0.50%, Si=2.0%, Cr=1.0%, Mn=0.60% and Mo=0.20% and Cu=0.50% with S and P as low as possible. The $M_s$ temperature of such steels can be expressed as:

$$M_s=1000-(650\times\%\ C)-(70\times\%\ Mn)-(35\times\%\ Ni)-(70\times\%\ Cr).$$

The calculated $M_s$ temperature of the steel was 565° F. Inclusion of high silicon will help in the prevention of cementite formation during the transformation to upper bainite. The addition of chromium will help in reducing graphitization and improving hardenability. It helps to depress the $M_s$ temperature. The carbon content has been selected as 0.50%, which is a sufficient amount of carbon to depress the $M_s$ temperature and inhibit pearlite formation during austempering. Carbon also helped to depress the upper to lower bainite boundary transition line. This allows initial quenching of the steel to a lower austempering temperature thereby achieving further refinement of bainitic ferrite-austenite structure. Addition of a small amount of molybdenum helps to attain higher hardenability. In a refinement, copper is also added to the composition. While copper is not normally a desirable addition in steel because of the formation of pearlite phase, it can improve corrosion resistance. In the present refinement, the addition of copper did not produce any detectable amount of the pearlite phase.

EXPERIMENTAL PROCEDURE

Material

The material used for the present investigation is a medium carbon low alloy steel with a high silicon content. The chemical composition of the material in weight percentage is reported in Table 1 (balance is substantially all iron). This steel had 0.4% carbon and 2.0% silicon, with small amount of alloying elements such as nickel, molybdenum, chromium, and copper. This steel was melt, cast, hot rolled and annealed at 900° C. for 1 hour. The microstructure of the as-cast material is shown in FIG. 1. The as-cast structure was pearlitic in nature. From the hot rolled and annealed block, compact tension samples for fracture toughness tests and cylindrical samples for tensile tests were prepared following ASTM standards E-399 and E-8, respectively. The thickness (B) of the compact tension samples was kept at B=19.1 mm and the aspect ratio (a/W) was kept at a/W=0.45. The width (W) of these samples was kept at W=40.4 mm.

TABLE 1

Chemical composition of the material (wt %)

| | |
|---|---|
| C | 0.40 |
| Si | 2.00 |
| Mn | 0.40 |
| Ni | 1.00 |
| Cr | 0.80 |
| Mo | 0.30 |
| Cu | 0.50 |
| S | 0.006 |
| P | 0.01 |

Heat Treatment:

After fabrication, the tensile and compact tension samples were austenized for a time of 2 hours at 927° C. After austenitizing these samples were austempered for 2 hours at several austempering temperatures of 315° C. (600° F.), 357, 385 and 399° C. Austenitizing times of less than 2 hours were not selected to ensure complete transformation of the as-cast structure into austenite requires. An austempering time of 2 hours was found to be insufficient to induce complete transformation to the austenite phase.

Figure 2:
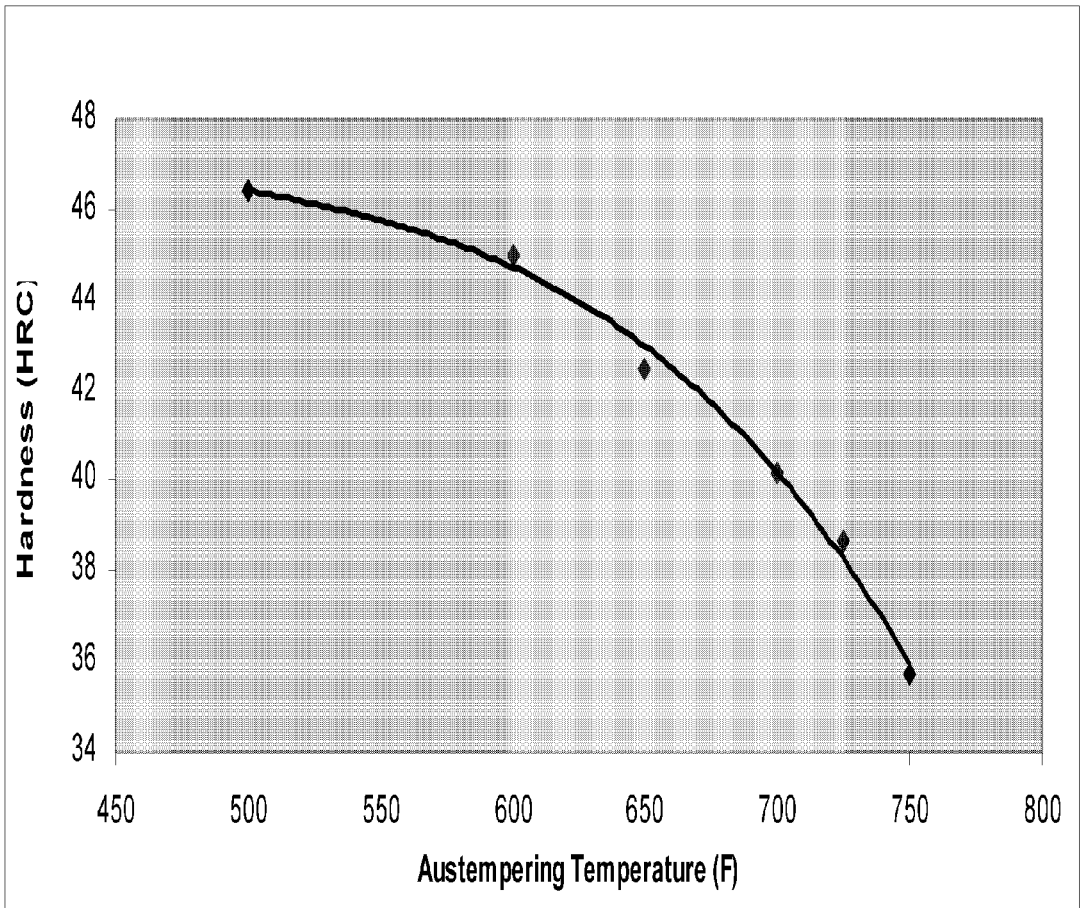
FIG. 2 provides a plot of the hardness versus the austempering temperature.
Figure 3:
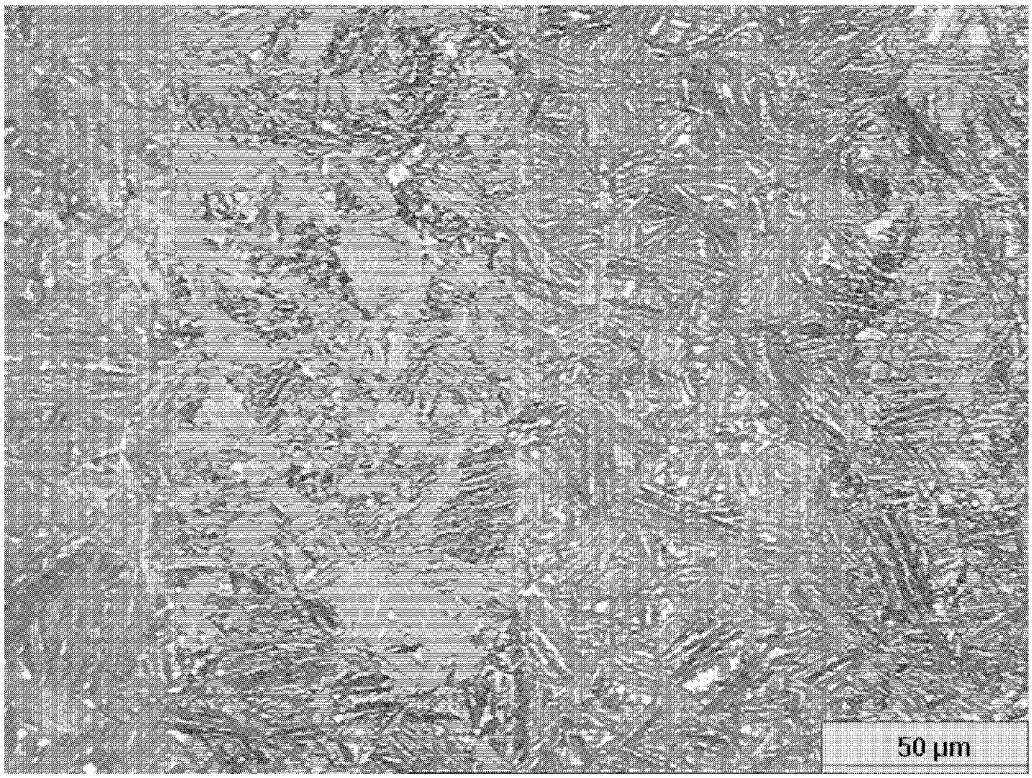
FIG. 3 provides the microstructure of HCHS steel austempered at 550° F.
Figure 4:
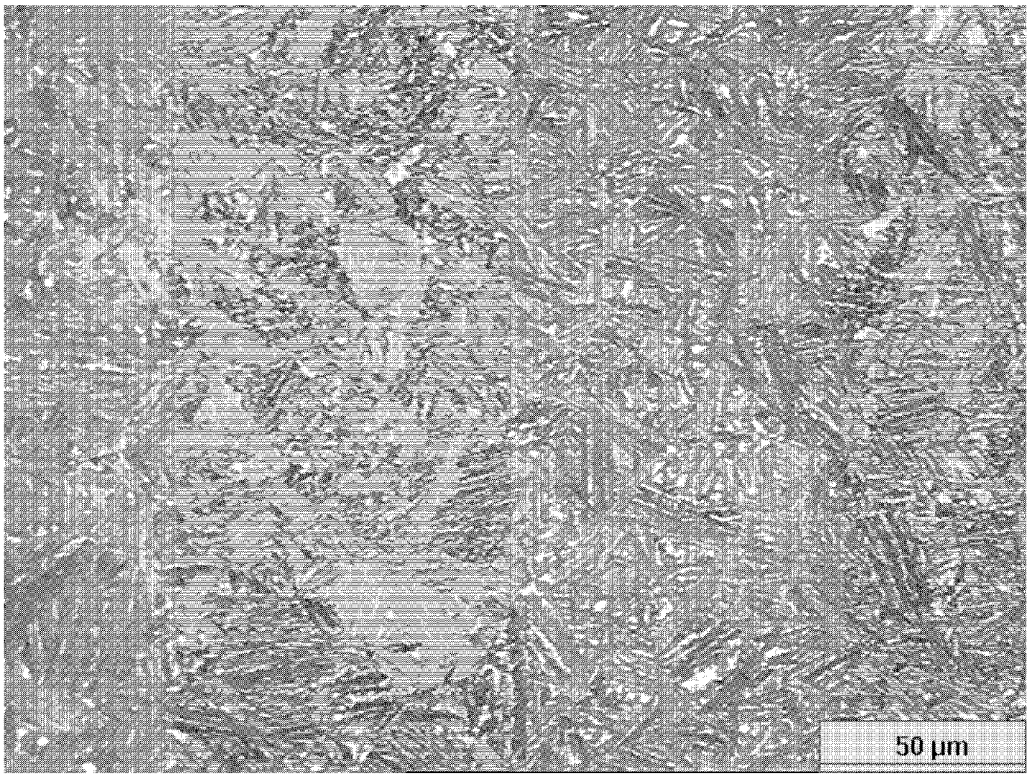
FIG. 4 provides the microstructure of HCHS steel austempered at 650° F.
Figure 5:
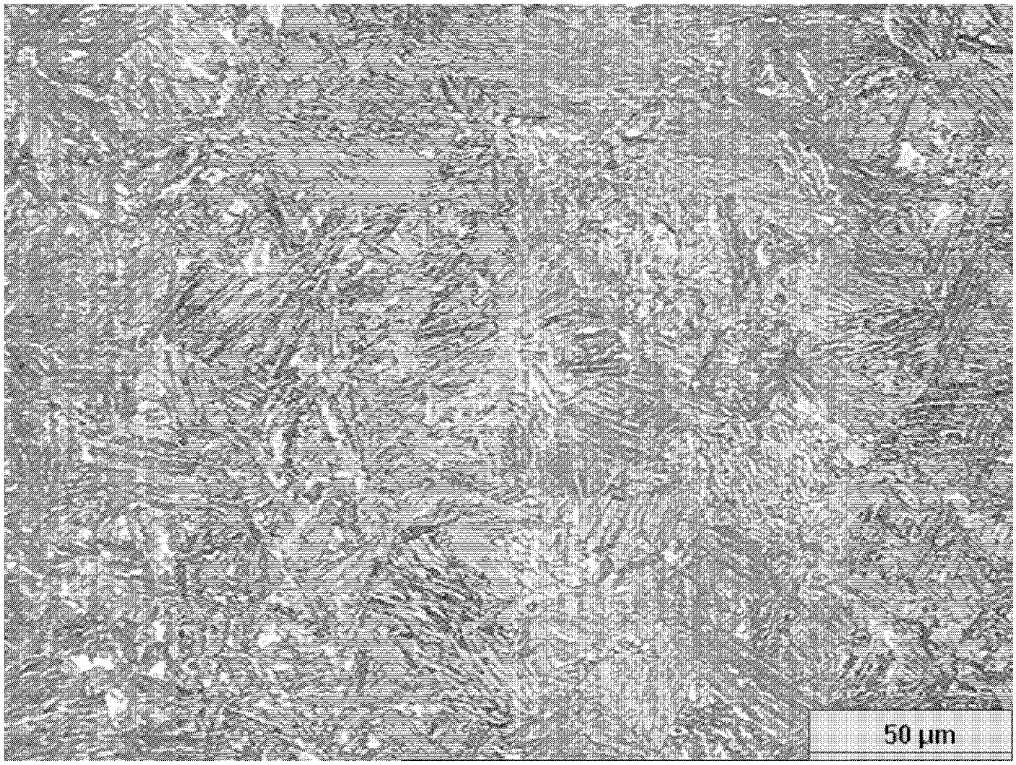
FIG. 5 provides the microstructure of HCHS steel austempered at 700° F.
Figure 6:
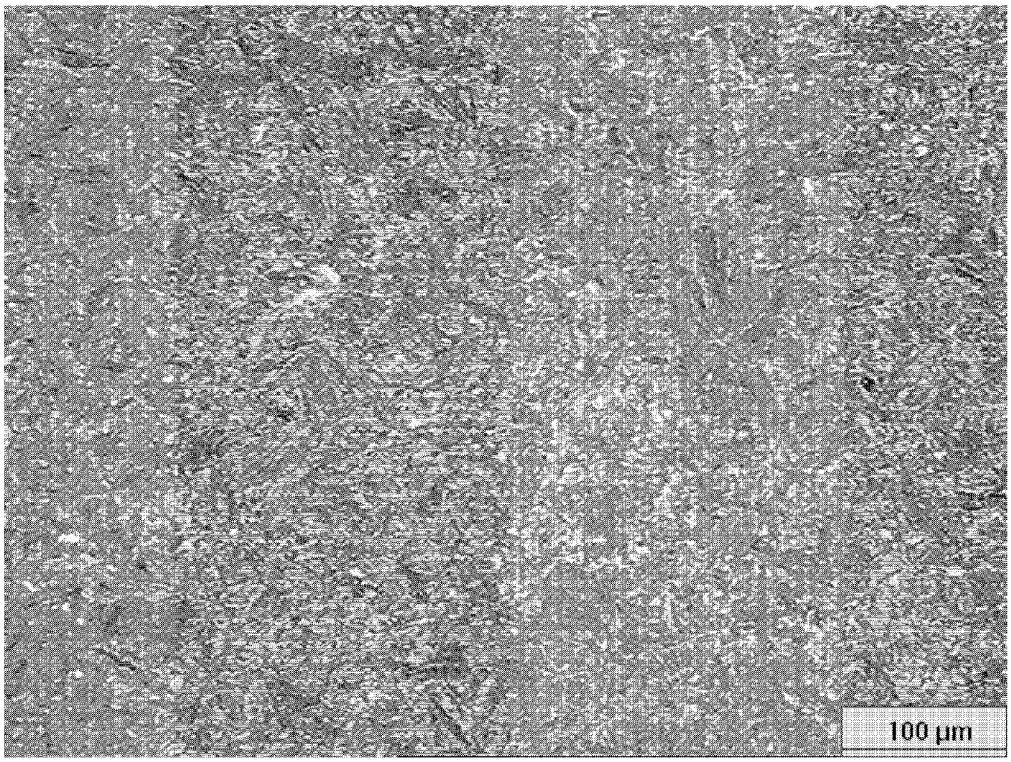
FIG. 6 provides the microstructure of HCHS steel austempered at 725° F.
Figure 7:
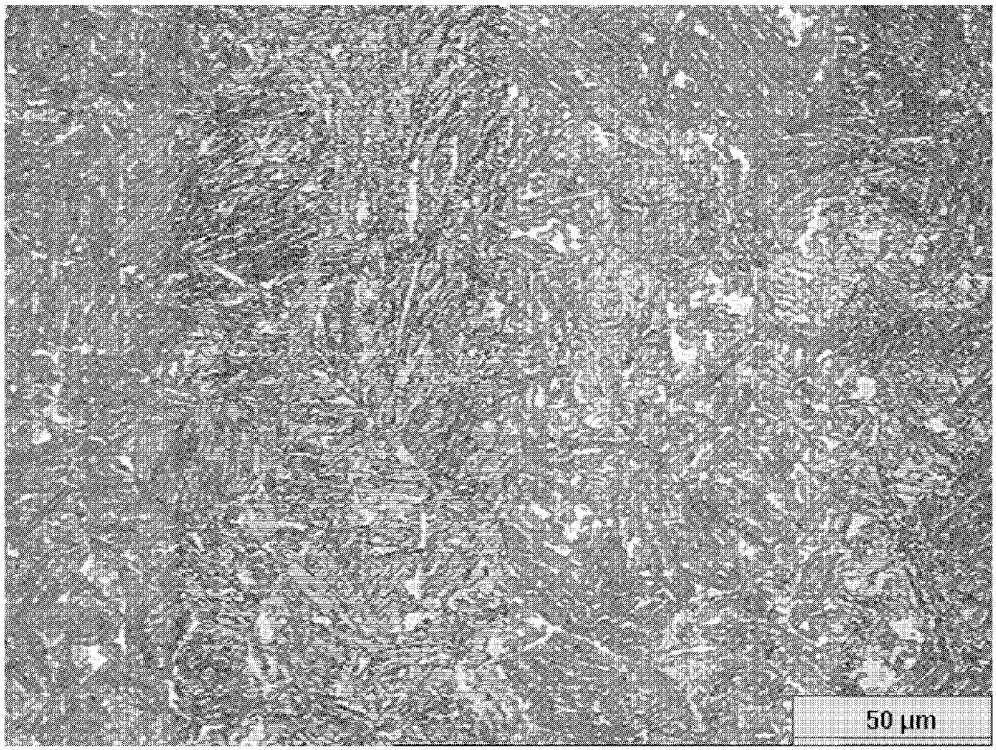
FIG. 7 provides the microstructure of HCHS steel austempered at 750° F.
Figure 8:
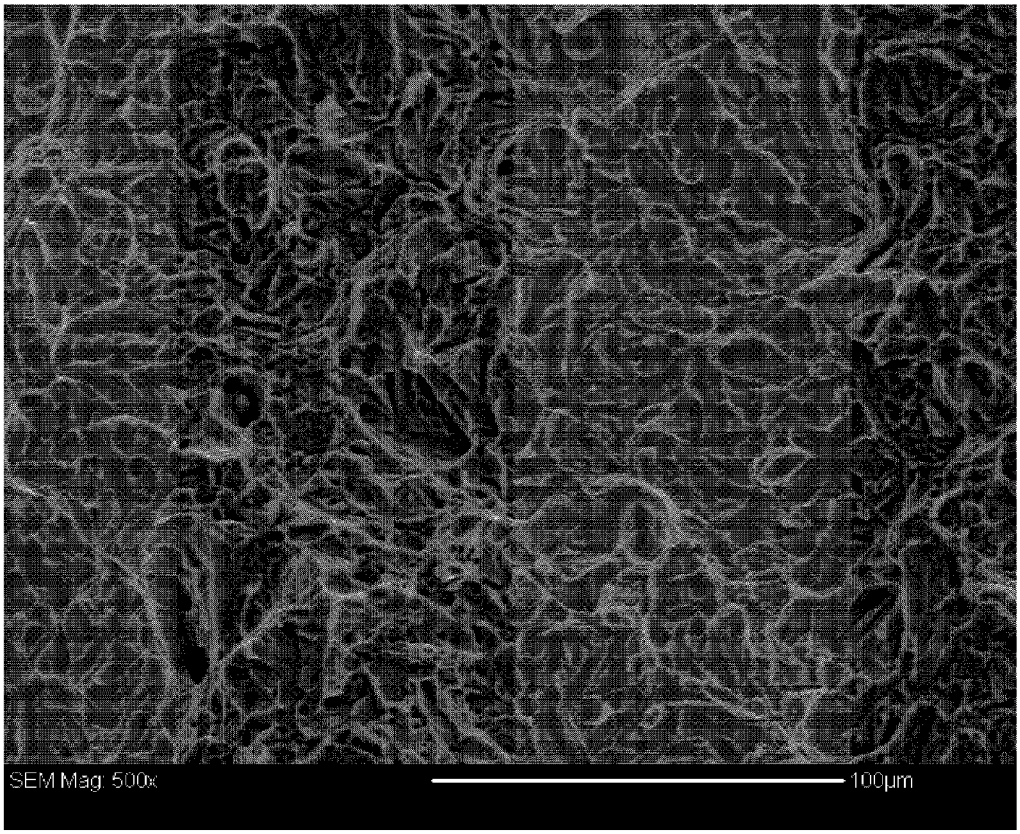
FIG. 8 provides a fractograph of the material (500° F.)
Figure 9:
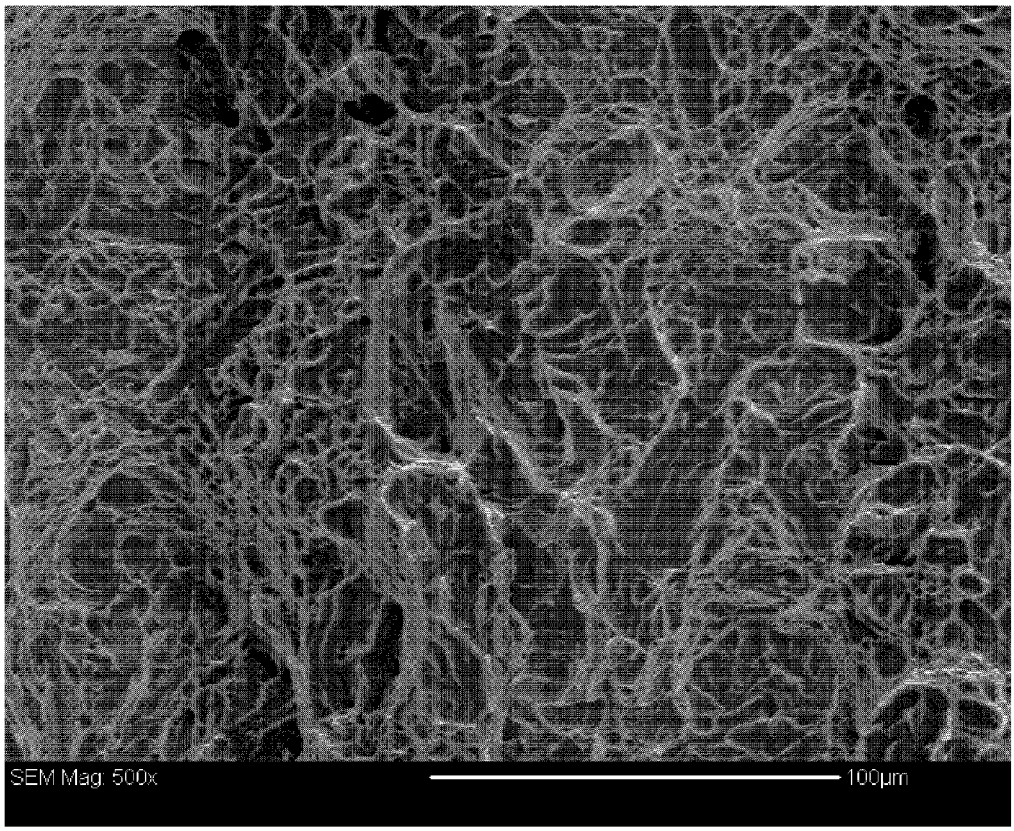
FIG. 9 provides a fractograph of the material (600° F.)
Figure 10:
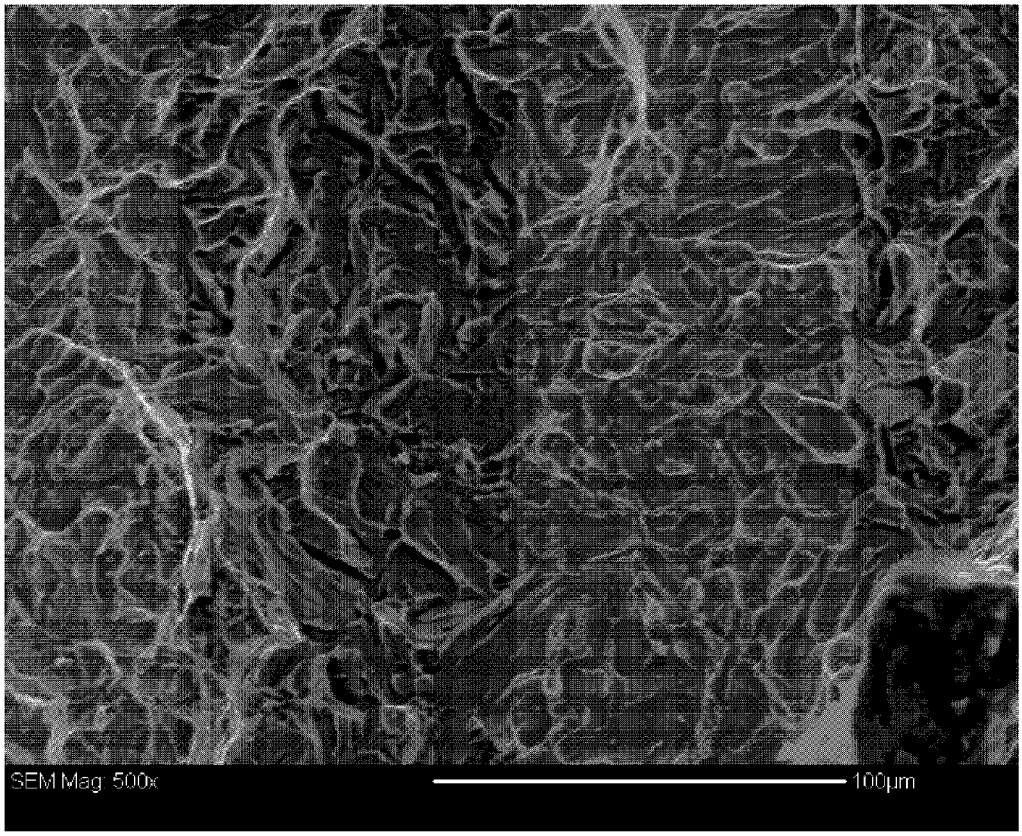
FIG. 10 provides fractograph of the material (700° F.)
Figure 11:
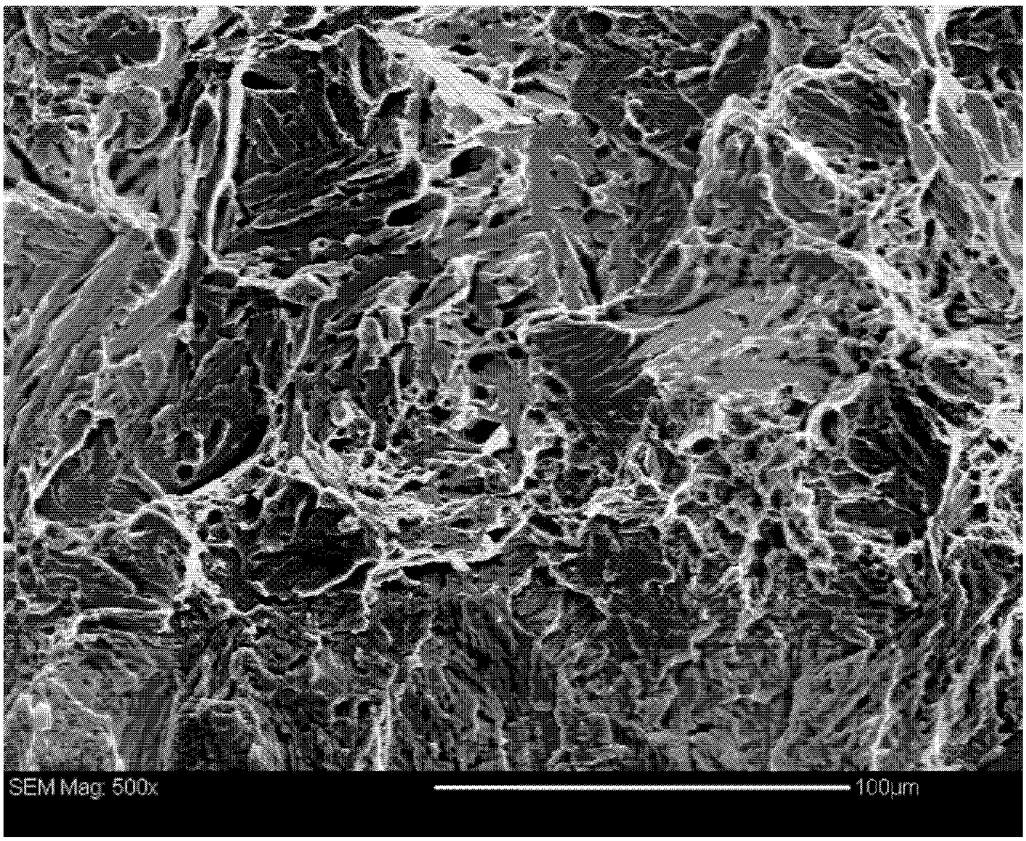
FIG. 11 provides a fractograph of the material (725° F.)

Mechanical Testing:

After heat treatment, the compact tension samples were ground and then polished with 600 grit emery paper. The specimens were then precracked in fatigue at a ΔK level of 10 MPa√m to produce a 2 mm long sharp crack front in accordance with ASTM standard E-399. After fatigue pre-cracking, the specimens were loaded in tension in a servo-hydraulic MTS test machine and the load displacement diagrams were obtained with a clip gage in the knife edge attachment on the specimen. $P_Q$ values were calculated from the load-displacement diagrams using the 5% secant deviation technique per ASTM standard E-399. $K_Q$ values were determined from the $P_Q$ values using the standard stress intensity factor calibration function for compact tension specimens. Since these $K_Q$ values satisfied all the requirements of a valid $K_{IC}$ test per ASTM standard E-399, these values were all valid $K_{IC}$ values. Five identical test specimens were tested from each heat-treatment condition. The values reported herein are the averages from these five tests. Hardness of the samples was measured on the Rockwell 'C' scale. Ten readings were taken on each sample and the average of the ten readings is reported in FIG. 2. These measurements show that the hardness decreases with the austempering.

Tensile testing of all these samples was also carried out on a servo-hydraulic MTS test machine as per ASTM standard E-8. Tests were carried out at a constant engineering strain rate of $4\times10^{-4}$. Five identical samples were tested and the yield and tensile strength were calculated from the load versus displacement plots on an X-Y recorder. The average values from five identical samples together with the range of values are reported in Table 2.

TABLE 2

Mechanical properties of HCHS steel

| Austempering temp (° F.) | Yield strength (MPa) | Ultimate Tensile Strength (MPa) | Elongation (%) |
|---|---|---|---|
| As-cast | 507.5 | 882 | 16.5 |
| 500 | 1423.0 | 1779 | 10.1 |
| 600 | 1336.0 | 1653 | 11.5 |
| 650 | 1244.5 | 1381 | 12.7 |
| 700 | 1103.5 | 1408 | 14.9 |
| 750 | 864.5 | 1354 | 18.5 |

X-Ray Diffraction:

X-ray diffraction (XRD) analysis was performed to determine the austenite content and the percentage of carbon in austenite. XRD was done using a monochromatic Cu Ka radiation at 40 kV and 100 mA. A Rigaku rotating head anode diffractometer was used to scan the angular 2u range of 42-46° at a scanning speed of 0.5°/min. The profiles were analyzed on a computer to obtain the peak positions and the integrated intensity of the {111}, {220} and {311} planes of austenite and the {110} and {211} planes of BCC ferrite. The volume fraction of ferrite ($X_\alpha$) and austenite ($X_\gamma$) were determined by the direct comparison method using the integrated intensities of the {110} and {211} planes of ferrite and the {111}, {220} and {311} planes of austenite. The carbon content of austenite was determined using the following equation:

$$a_\gamma=0.3548+0.0044C_\gamma$$

where $a_\gamma$ is the lattice parameter of austenite in nm and $C_\gamma$ is the carbon content of austenite by weight percentage. The {111}, {220} and {311} planes of austenite were used to estimate the lattice parameter.

Metallography and Fractography:

Microstructures of the heat-treated samples were examined by optical microscopy after etching with 2% nital solution. (FIGS. 1, 3, 4, 5, 6, and 7). Fracture surfaces of the fracture toughness samples were examined on a Hitachi S-2400 scanning electron microscope using an accelerating voltage of 20 Kv to determine the failure mode. Samples were also examined under a scanning electron microscope (SEM) to determine the nature of the phase, i.e. ferrite or austenite, present in the microstructure. FIGS. 8, 9, 10, and 11 provide fractographs of steels made by the methods set forth above.

Magnetic and Thermodynamic Properties Measurement:

The magnetic properties of the austempered samples were characterized between T=10 and 300° K at magnetic fields up to H=2T. The experiments are carried out using a Quantum Design MPMS SQUID magnetometer with samples weighing approximately 5 mg. The thermal conductivity and electrical sensitivity of the samples were measured simultaneously between T=10 K and T=300 K using the thermal Transport optical QD PPMS. The steel samples were cut into 0.090"×0.150"×0.500" bars with the four gold plated copper leads for transport measurements attached using silver epoxy.

Results and Discussion 3.1. Microstructure:

The microstructure of the material after austempering at several temperatures are reported in FIGS. 3, 4, 5, 6 and 7 respectively. While the samples austempered at 260° C. (500° F.) showed a microstructure similar in appearance to tempered martensitic structure, the samples austempered at 316° C. (600° F.), 357° C. (650° F.), 371° C. (700° F.), 385° C. (725° F.) and 400° C. (750° F.) showed a microstructure consisting of a mixture of lower bainitic and austenite. Moreover some presence of martensite was also observed in these samples. The steel had some banded structure or segregated region probably due to the presence of chromium. In these segregated regions, the austempering reaction is very sluggish and transformation of austenite into ferrite during the first reaction (equation 1) does not take place. Therefore, these regions retained austenite transforming into martensite on cooling. Accordingly, these samples contain some martensite after austempering at 600° F., 650° F., 700° F. and 750° F. Interestingly, even though some of the samples were austempered in the upper bainitic region (700° F. and above), no upper bainitic microstructure typical of ADI could be obtained in this steel. This again appears due to the presence of segregated regions in the steel that prevented the upper bainitic transformation.

The austenite appears as slivers between the ferrite needles. The volume fraction of the austenite was determined in these samples by x-ray diffraction. Table 3 shows the austenite volume fraction as a function of austempering temperature.

TABLE 3

Volume fraction of Austenite

| Austempering temp ° F. (° C.) | Volume fraction of Austenite (%) |
|---|---|
| 600 (315.5) | 7.2 |
| 650 (343.3) | 11.1 |
| 700 (371.1) | 14.8 |
| 725 (385) | 15.1 |
| 750 (398.8) | 16.2 |

The austenite content was found to increase as the austempering temperature increased from 600° F. to 750° F. The carbon content of the austenite was determined from the lattice parameter of austenite and these values are reported in Table 4.

TABLE 4

| Austempering temp (° F.) | Carbon content of Austenite ($C_\gamma$ %) | $X_\gamma C_\gamma$ |
|---|---|---|
| 600 | 1.80 | 12.6 |
| 650 | 1.62 | 17.82 |
| 700 | 1.93 | 28.56 |
| 725 | 1.86 | 27.9 |
| 750 | 1.51 | 24.16 |

The initial carbon content $C_0$ of the austenite at the given austempering temperature is given by the following expression.

$$C_0=(T_\gamma/420)-0.17(\mathrm{Si})-0.95$$

where, $T_\gamma$ is austempering temperature in degree Celsius and Si is the silicon content in weight percent. In the present investigation $T_\gamma$ is 927° C. and silicon content is 2%. Substituting these values in the above equation $C_0$ is found to be in the range of 0.3 for this steel. This is the carbon content of the austenite at the austenitizing temperature. The amount of carbon that finds its way into the final austenite content of the matrix depends on the kinetic factors and is given by $$C_0=X_\alpha C_\alpha+X_\gamma C_\gamma$$

where $X_\alpha$ is the volume fraction of ferrite, $C_\alpha$ is the carbon content of ferrite, $X_\gamma$ is the volume fraction of austenite, $C_\gamma$ is the carbon content of austenite. Since ferrite dissolved very little carbon i.e, $C_\alpha$≈negligible, the follow formula can approximate $C_0$:

$$C_0=X_\alpha C_\alpha$$

Since $C_0$ is constant, as $X_\gamma$ increases, the $C_\gamma$ decreases.

Figure 12:
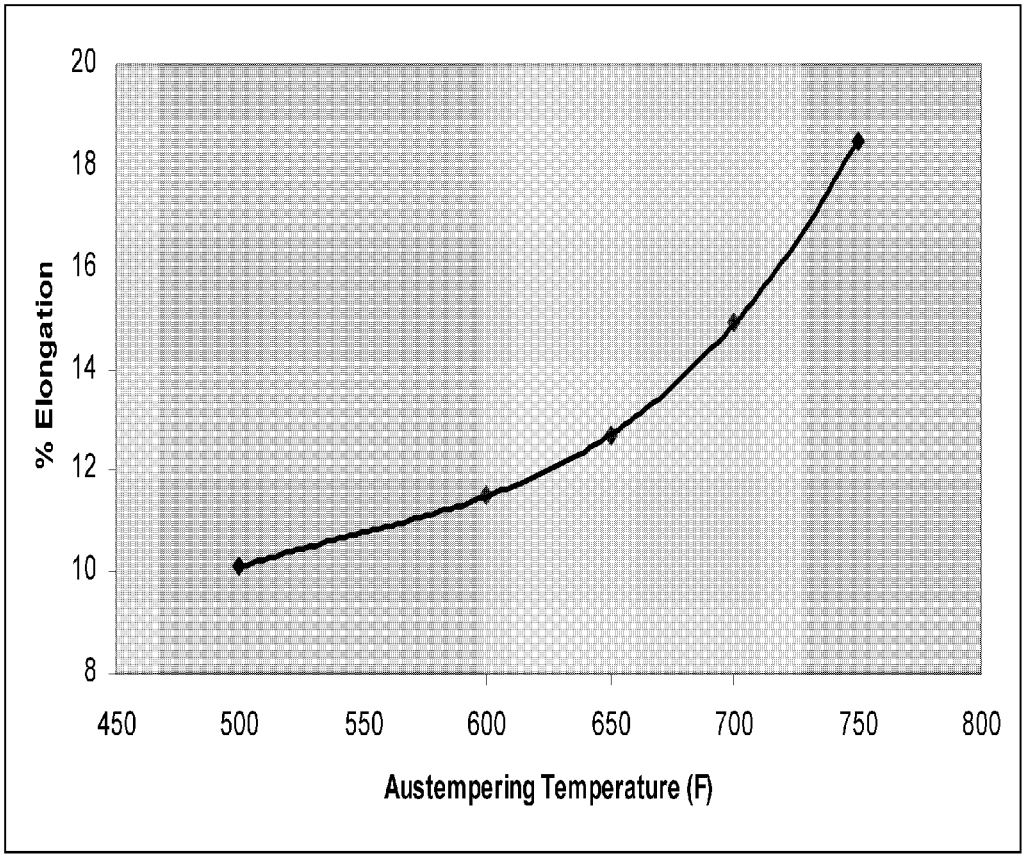
FIG. 12 provides a plot of the percent elongation versus the austempering temperature.

3.2. Mechanical Properties:

The tensile properties of the material after austempering at several temperatures were investigated. The as-cast microstructure had relatively low strength (compared to austempered structures) but with high ductility. The samples austempered at 500° F. had exceptionally high strength ($\sigma_{ys}$≈1413 MPa which is more than 200 Ksi) but still with considerable amount of ductility (% elongation≈10%). As the austempering temperature increased, both the yield and tensile strength decreased. FIG. 12 is a plot of % elongation as a function of austempering temperature. The ductility of the material increased considerably as the austempering temperature increased. This increase is related to the presence of more austenite in the matrix. The austenite is a FCC phase and has high ductility and toughness. Presence of increased amount of austenite therefore increases the ductility of the material.

The hardness values of the material are reported in Table 5. It is evident that as the austempering temperature increases, the hardness of the material decreases. Presence of increasing amount of austenite causes increase in ductility and consequently decreases in hardness as the austempering temperature increases.

TABLE 5

Effect of austempering temperature on Hardness

| Austempering Temp ° F. (° C.) | Hardness (HRC) |
|---|---|
| As-cast | 20.0 |
| 500 (260) | 46.3 |
| 600 (315.5) | 45.0 |
| 650 (343.3) | 42.5 |
| 700 (371.1) | 40.2 |
| 725 (385) | 38.7 |
| 750 (398.8) | 35.8 |

Fracture Toughness:

Table 6 reports the fracture toughness of the material after austempering at different temperatures. The fracture toughness values of this steel were significantly higher than traditional low alloy steels after quench and tempering. The plain strain fracture toughness of low alloy steels in quenched and tempered condition generally are in the range of 40-60 MPa√m. However in our case, the fracture toughness values were significantly higher. It ranged from 42.8 MPa√m in the as-cast condition to a value of 116.2 MPa√m after austempering at 600° F. It is of great interest to note that the value of the fracture toughness of this steel after austempering at 600° F. was exceptionally high (116.2 MPa√m) and was comparable to maraging steels. Moreover the yield strength of the steel at this austempering temperature was also very high (1336 MPa≈200 Ksi). Thus, a remarkable combination of very high yield strength and fracture toughness has been produced in this steel after austempering at 600° F.

TABLE 6

Fracture Toughness of Steel

| Austempering Temp (° F.) | Fracture Toughness (MPa√m) |
|---|---|
| As-cast | 42.8 |
| 500 | 84.5 |
| 600 | 116.2 |
| 650 | 96.3 |
| 700 | 75.8 |
| 725 | 74.4 |
| 750 | 62.6 |

The fracture toughness values of the steel were observed to decrease beyond 600° F. even though the austenite content increased beyond 600° F. Austenite is an FCC, ductile and tough phase. As the austenite content increases, one would therefore expect the fracture toughness of the steel would also increase. However, in the present case the opposite trend is observed. As the austenite content increased from 600° F. to 750° F., the fracture toughness values actually decreased. The reason for this behaviour appears to be due to several factors. It was observed in the case of ADI that the fracture toughness is related to yield strength as well as the total carbon content of the austenite ($X_\gamma C_\gamma$). The following equation models this relationship:

$$K_{IC}^2 \prec \sigma_Y (X_\gamma C_\gamma)^{1/2}$$

Figure 13:
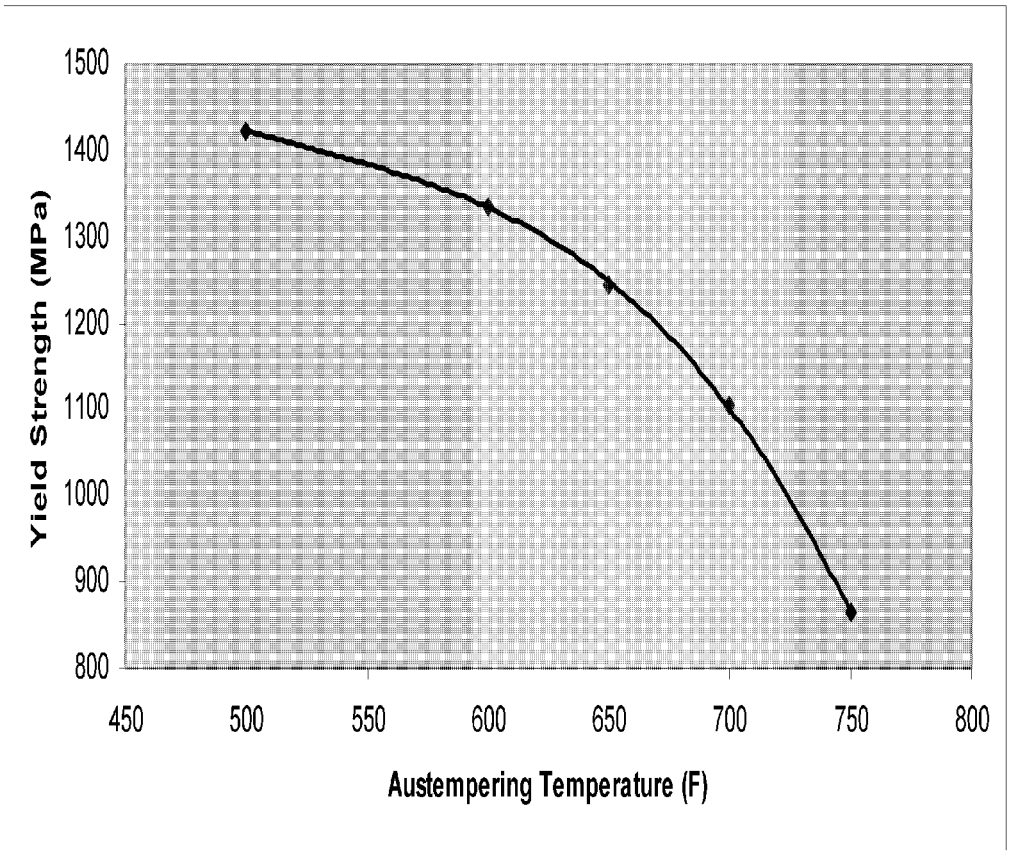
FIG. 13 provides a plot of the yield strength versus the austempering temperature.
Figure 14:
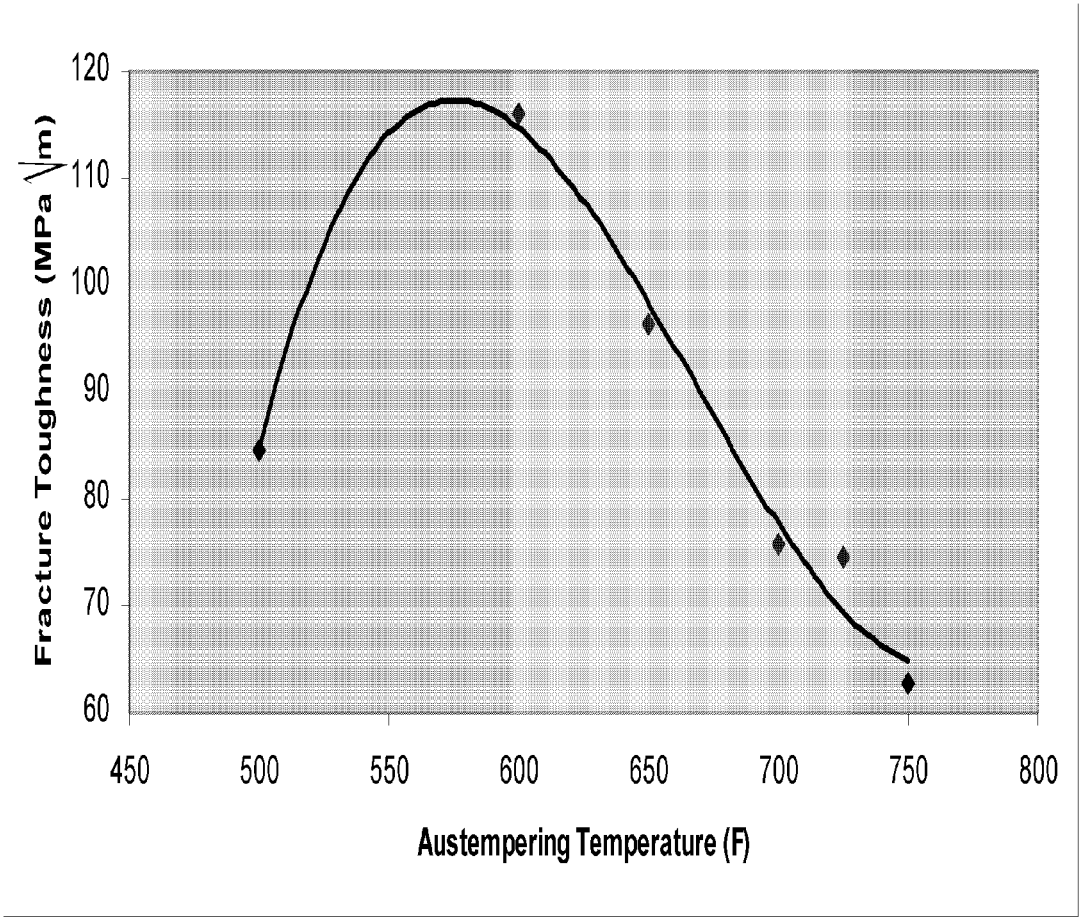
FIG. 14 provides a plot of the fracture toughness versus the austempering temperature.

Thus when $K_{IC}^2$ is plotted against the parameter $\sigma_Y(X_\gamma C_\gamma)^{1/2}$, a straight line relationship is expected. In FIG. 13, a plot of the yield strength versus austempering temperature is provided. In FIG. 14, a plot of the fracture toughness versus austempering temperature is provided.

In ADI, the excellent properties of ADI such as good ductility at comparatively high strength levels, excellent wear resistance and superior fatigue properties are due to the ability of the austenite to strain harden or to transform to martensite when subjected to loading. Therefore, it is important to look at the difference of fracture toughness on the stability of the austenite phase. In order to investigate this, the fracture surfaces of the samples after each heat treatment connection were subjected to metallographic studies. A 2 mm thick sample was cut from the fracture end. The fracture surface was studied under optical microscope after polishing and etching with nital. In these samples, martensite was observed only on those samples that had more austenite in the matrix before loading and not on those that had lower austenite.

Precision manufacturers have reported that stress-induced martensite can form on ADI. It has been shown through TEM investigation the formation of very fine needles like martensite in ADI after monatomic compression. There was a simultaneous increase in the hardness as well as reduction in austenite content with increasing deformation. The beneficial effect of martensite formation on the surface on the sliding dry wear behaviour of ADI is also known. Finally, magnetic measurements have shown the formation of stress induced martensite in ADI under tensile loading.

Further studies with regard to martensite formation were carried out on partly fracture samples. It was found that martensite formed copiously near the crack surface. The amount of martensite decreased is merged away from the crack. Similarly, in the region just ahead of the crack, tip too, martensite was found to form in abundance. The crack tip region is subjected to large stress concentration. This causes the formation of martensite in this region during the loading process. X-ray diffraction studies were carried out on the fracture surfaces after polishing them to estimate the retained austenite. It was observed that there is reduction in retained austenite content after deformation in all the samples.

Figure 15:
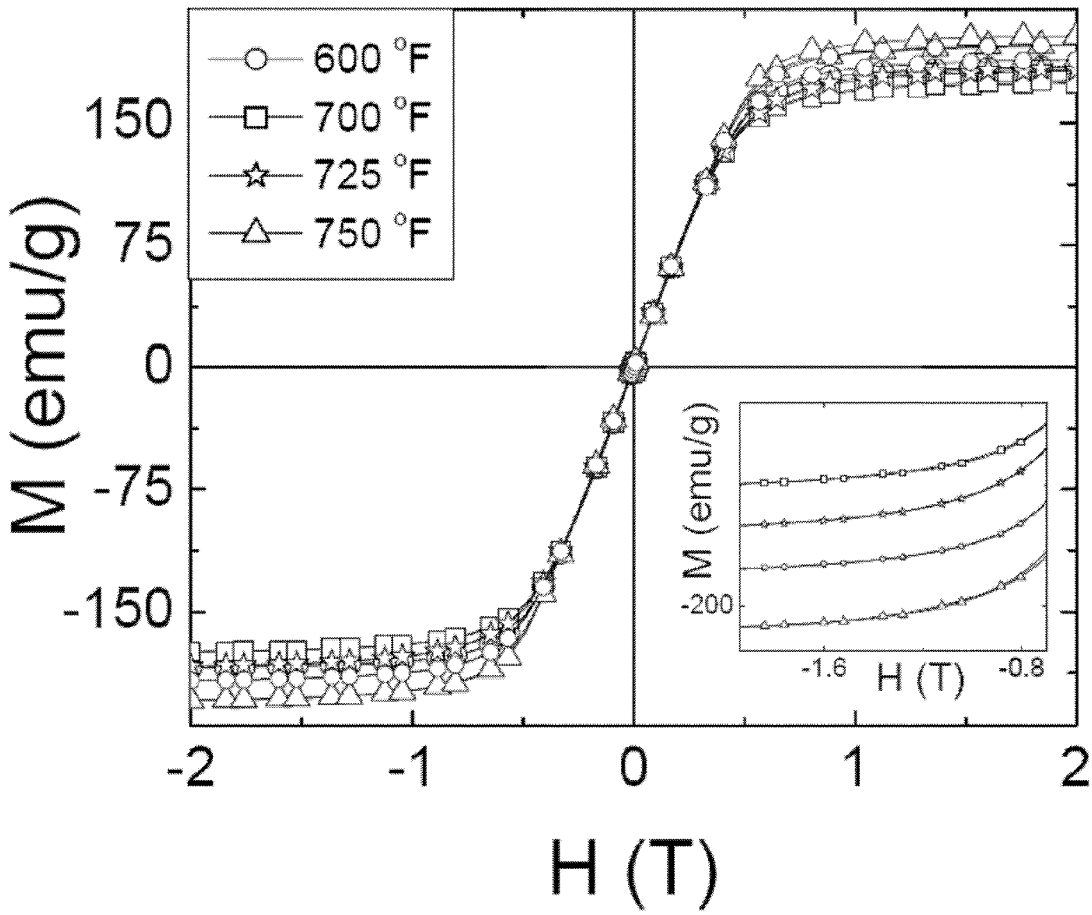
FIG. 15 provides a plot of the net magnetization of several different steel samples as a function of applied field.

Electrical, Magnetic and Thermal Properties:

FIG. 15 provides a plot of the net magnetization of several different steel samples as a function of applied field. The saturation magnetization ranges from approximately 175 emu/g to just over 200 emu/g. In the simplest model, the saturation magnetization should vary with ferritic fraction, since the austenite structure is only very weakly magnetic. However, the saturation magnetization of the samples in these does not vary monotonically with ferritic fraction. The sample austempered at 600° F., having the largest ferrite (smallest austenite) fraction, has the second largest saturation magnetization of approximately 192 emu/g, while the 750 austempered sample, having the smallest ferrite fraction, actually has the largest saturation magnetization of approximately 204 emu/g. For all samples, the coercive magnetic field falls between 5 Oe and 25 Oe.

The observation that the saturation magnetization in these samples does not simply vary with the ferritic fraction is consistent with the very large values of magnetization. The saturation magnetization for ferritic steel samples shows considerable sample-to-sample variation, but typically falls in the range of 150 emu/g, which is significantly smaller than the values being measured. However, several studies have shown that the magnetization is sensitive to strain effects and microstructural distortions associated with the martensitic phase transition [K. Mumtaz, S. Takahashi, J. Echigoya, L. F. Zhang, Y. Kamada, and M. Sato, "Use of saturation magnetism to detect martensite formation in austenitic stainless steel after compressive deformation at high temperatures", Journal of Materials Science Letters 21, 1199 (2002)]; significant strain is expected at the interface between the austenitic and ferritic structures in these inhomogeneous samples. It is believed that the magnetic moment in these samples has contributions from both the bulk magnetization of the ferritic component and from the strain induced magnetization at the boundary between the ferrite and austenite phases. Within this framework, it can be argued that the saturation magnetization for the 750° F. austempered sample is large because there is a large interface between the austenitic and ferritic components.

Figure 16:
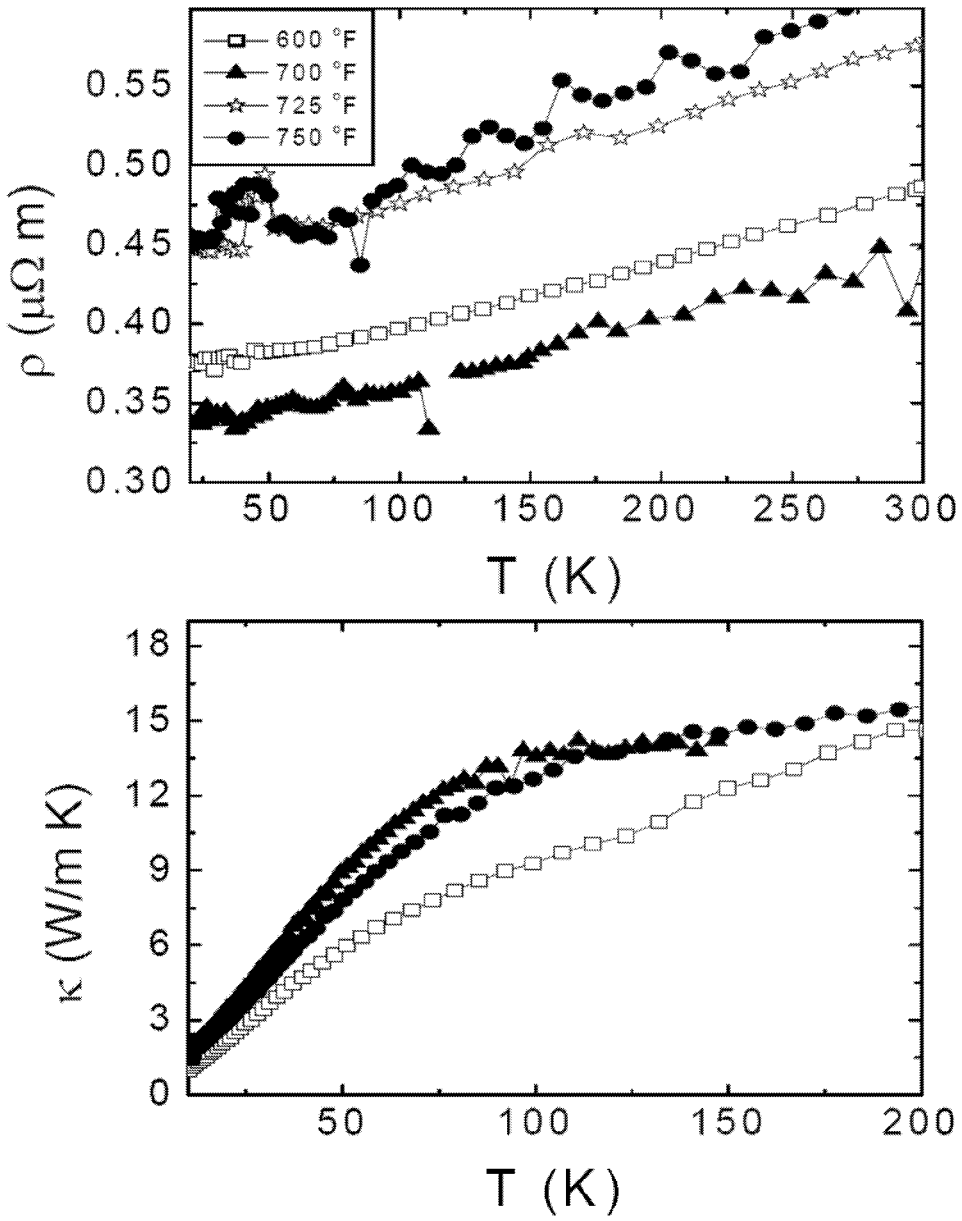
FIG. 16 provides plots of the temperature dependent thermal and electrical transport properties for the different samples.

FIG. 16 provides plots of the temperature dependent thermal and electrical transport properties for the different samples. Due to technical limitations defined by sample geometry, it was only possible to reliably measure the thermal conductivity up to approximately T=200 K, beyond which temperature the heater used for this measurement was saturated. Additionally, because of poor thermal contact, reliable data on the steel sample austempered at 725° F. was not attainable. The room temperature resistivities of the samples varied from approximately 0.4 to 0.6 μΩ-m, slightly larger than typical values for cast steel, but slightly lower than values for 304 stainless steel. A general trend that the two samples with higher volume fractions of austenite (the 725° F. and 750° F. austempered samples) have small resistivities is observed, while the two samples with lower volume fractions of austenite have higher resistivities. This perhaps suggests that scattering at the boundaries between the austenite and ferrite structures contributes only very weakly to the resistivity. The Residual Resistance Ratio (RRR) values for the samples, the ratio between the room temperature and T=4.2 K resistance, varies from approximately 1.2 to 1.3. This small RRR value implies that charge carrier scattering from static sites is the dominant contributor to the resistance in these samples. The thermal conductivity for the 600° F. austempered sample having a larger volume fraction of austenite is slightly reduced from the value of the thermal conductivity for the other two samples lower temperatures. However, by T=200 K, the thermal conductivity for all three samples is very similar.

While embodiments of the invention have been illustrated and described, it is not intended that these embodiments illustrate and describe all possible forms of the invention. Rather, the words used in the specification are words for description rather than limitation, and it is understood that various changes may be made without departing from the spirit and scope of the invention.

What is claimed is:

1. A method of forming a steel, the method comprising:

a) providing a steel alloy composition comprising iron, carbon in an amount from about 0.2 weight percent to about 2.0 weight percent, silicon in an amount from about 1.8 weight percent to about 5 weight percent, manganese in an amount from about 0.1 to 0.4 weight percent, nickel in an amount from about 0.5 to 2 weight percent, chromium in an amount from about 0.5 to about 1.5 weight percent, molybdenum in an amount from about 0.1 to about 0.6 weight percent, and copper in an amount from about 0.1 to about 0.8 weight percent;

b) heating the steel alloy composition to a temperature of at least 500° F., and c) maintaining the temperature of the steel alloy composition at a temperature of at least 500° F. for a period of time sufficient to induce transformation of the steel alloy to obtain ferrite and carbon-enriched austenite, the ferrite being present in an amount of at least 80 volume percent and the carbon-enriched austenite being present in an amount of at least 5 volume percent and wherein the steel has a tensile strength of at least 1354 MPa.

2. The method of claim 1 wherein the steel alloy is maintained at a temperature of at least 500° F. for a sufficient time to transform from about 5 volume percent to about 20 volume percent of the steel alloy composition to austenite.

3. The method of claim 1 wherein the steel alloy composition comprises silicon in an amount from about 1.8 weight percent to about 2.5 weight percent.

4. The method of claim 1 wherein the steel alloy composition comprises carbon in an amount from about 0.3 weight percent to about 0.7 weight percent.

5. The method of claim 1 wherein the steel alloy includes sulfur in an amount from about 0.001 to about 0.01 weight percent and phosphorus in an amount from about 0.001 to about 0.05 weight percent.

6. The method of claim 1 wherein the steel alloy composition in step c) is maintained at a temperature between 500 to about 800° F.

7. The method of claim 1 wherein the steel alloy composition in step c) is maintained at a temperature between about 600 to about 750° F.

8. A steel comprising at least 80 volume percent ferrite and at least 5 volume percent carbon-enriched austenite, the steel including iron, carbon in an amount from about 0.2 weight percent to about 2.0 weight percent, silicon in an amount from about 1.8 weight percent to about 5 weight percent, manganese in an amount from about 0.1 to 0.4 weight percent, nickel in an amount from about 0.5 to 2 weight percent, chromium in an amount from about 0.5 to about 1.5 weight percent, molybdenum in an amount from about 0.1 to about 0.6 weight percent, and copper in an amount from about 0.1 to about 0.8 weight percent and wherein the steel has a tensile strength of at least 1354 MPa.

9. The steel of claim 8 wherein the silicon is present in an amount from about 1.8 weight percent to about 2.5 weight percent.

10. The steel of claim 8 wherein the carbon is present in an amount from about 0.3 weight percent to about 0.7 weight percent.

11. The steel of claim 8 further comprising sulfur in an amount from about 0.001 to about 0.01 weight percent and phosphorus in an amount from about 0.001 to about 0.05 weight percent.

12. The steel of claim 8 comprising plates of ferrite separated by carbon enriched regions of austenite.

13. A method of forming a steel, the method comprising:

a) providing a steel alloy composition comprising iron, carbon in an amount from about 0.2 weight percent to about 2.0 weight percent, silicon in an amount from about 1.8 weight percent to about 5 weight percent, manganese in an amount from about 0.1 to 0.4 weight percent, nickel in an amount from about 0.5 to 2 weight percent, chromium in an amount from about 0.5 to about 1.5 weight percent, molybdenum in an amount from about 0.1 to about 0.6 weight percent, and copper in an amount from about 0.1 to about 0.8 weight percent;

b) heating the steel alloy composition to a temperature of at least 500° F.; and c) maintaining the temperature of the steel alloy composition at a temperature of 600 to about 750° F. for a period of time sufficient to induce transformation of the steel alloy to obtain ferrite and carbon-enriched austenite, the ferrite being present in an amount of at least 80 volume percent and the carbon-enriched austenite being present in an amount of at least 5 volume percent and wherein the steel has a tensile strength of at least 1354 MPa.

14. The method of claim 1 wherein carbon content of the austenite is from about 1.51 to about 1.93 weight percent.

15. The method of claim 1 wherein the steel includes plates of ferrite separated by carbon-enriched regions of austenite.

16. The steel of claim 8 wherein carbon content of the austenite is from about 1.51 to about 1.93 weight percent.

17. The method of claim 1 wherein the steel alloy composition is melted, cast, and hot rolled prior to step b).

18. The steel of claim 8 wherein the steel is formed by a method comprising:

a) melting, casting, and hot rolling a steel alloy composition;

b) heating the steel alloy composition to a temperature of at least 500° F., and c) maintaining the temperature of the steel alloy composition at a temperature of at least 500° F. for a period of time sufficient to induce transformation of the steel alloy to obtain ferrite and carbon-enriched austenite, the ferrite being present in an amount of at least 80 volume percent and the austenite being present in an amount of at least 5 volume percent.

19. The method of claim 1 wherein the steel alloy is melted, cast, and hot rolled prior to step b).

* * * * *